US007469901B1

(12) United States Patent
Hilliard

(10) Patent No.: US 7,469,901 B1
(45) Date of Patent: Dec. 30, 2008

(54) BATTLE PLAY CARD GAME

(76) Inventor: Michael J. Hilliard, 2715 Franklin Ave., Des Moines, IA (US) 50310

( * ) Notice: Subject to any disclaimer, the term of this patent is extended or adjusted under 35 U.S.C. 154(b) by 194 days.

(21) Appl. No.: 11/233,345

(22) Filed: Sep. 22, 2005

(51) Int. Cl.
*A63F 1/00* (2006.01)

(52) U.S. Cl. ..... 273/308

(58) Field of Classification Search ..... None
See application file for complete search history.

(56) References Cited

U.S. PATENT DOCUMENTS

| | | | | |
|---|---|---|---|---|
| 1,322,954 | A * | 11/1919 | Roseenfeld | 273/298 |
| 5,193,818 | A * | 3/1993 | Leeson | 463/10 |
| 5,662,332 | A * | 9/1997 | Garfield | 273/308 |
| 6,322,077 | B1 * | 11/2001 | Braunlich et al. | 273/292 |
| 6,402,152 | B1 * | 6/2002 | Kutzik | 273/296 |
| 6,435,508 | B1 * | 8/2002 | Tavel | 273/292 |
| RE37,957 | E * | 1/2003 | Garfield | 273/308 |
| 6,554,702 | B2 * | 4/2003 | Mahar et al. | 463/11 |
| 6,623,010 | B1 * | 9/2003 | Holland, Jr. | 273/292 |
| 6,651,984 | B1 * | 11/2003 | Luken | 273/292 |
| 7,144,013 | B2 * | 12/2006 | Tanaka | 273/308 |
| 2002/0043764 | A1 * | 4/2002 | Imhof | 273/292 |
| 2003/0168810 | A1 * | 9/2003 | Becker | 273/308 |
| 2003/0173741 | A1 * | 9/2003 | Pellham | 273/292 |
| 2005/0218595 | A1 * | 10/2005 | Gibbons et al. | 273/292 |
| 2006/0038349 | A1 * | 2/2006 | Meeks | 273/308 |

* cited by examiner

*Primary Examiner*—Gene Kim
*Assistant Examiner*—Dolores Collins

(57) ABSTRACT

A battle play card game is disclosed. The battle play card game utilizes a card deck having multiple character playing cards each having an offense points section for displaying a numerical value for offense points and a protect points section for displaying a numerical value for protect points. In use, players sequentially play the cards offensively or protectively to add points to their own point total and/or deduct points from their opponent's point total.

5 Claims, 10 Drawing Sheets

BATTLE PLAY CARD GAME

FIELD OF THE INVENTION

The present invention relates to card games. More particularly, the present invention relates to a battle-type card game in which opposing players play cards in an offensive or defensive manner to increase their own points or deduct points from their opponent.

BACKGROUND OF THE INVENTION

For years, cards have been a popular pastime for many. A conventional card deck can be used to play a large variety of games such as poker, hearts, solitaire, spades and bridge, for example. A card game is needed which is new, challenging and entertaining and can be mastered and played by children as well as adults.

SUMMARY OF THE INVENTION

The present invention is generally directed to a battle play card game. The battle play card game utilizes a card deck having multiple character playing cards each having an offense points section for displaying a numerical value for offense points and a protect points section for displaying a numerical value for protect points. In typical use, players sequentially play the cards offensively or protectively to add points to their own point total and/or deduct points from their opponent's point total.

BRIEF DESCRIPTION OF THE DRAWINGS

The invention will now be described, by way of example, with reference to the accompanying drawings, in which.

DETAILED DESCRIPTION OF THE INVENTION

Figure 1:
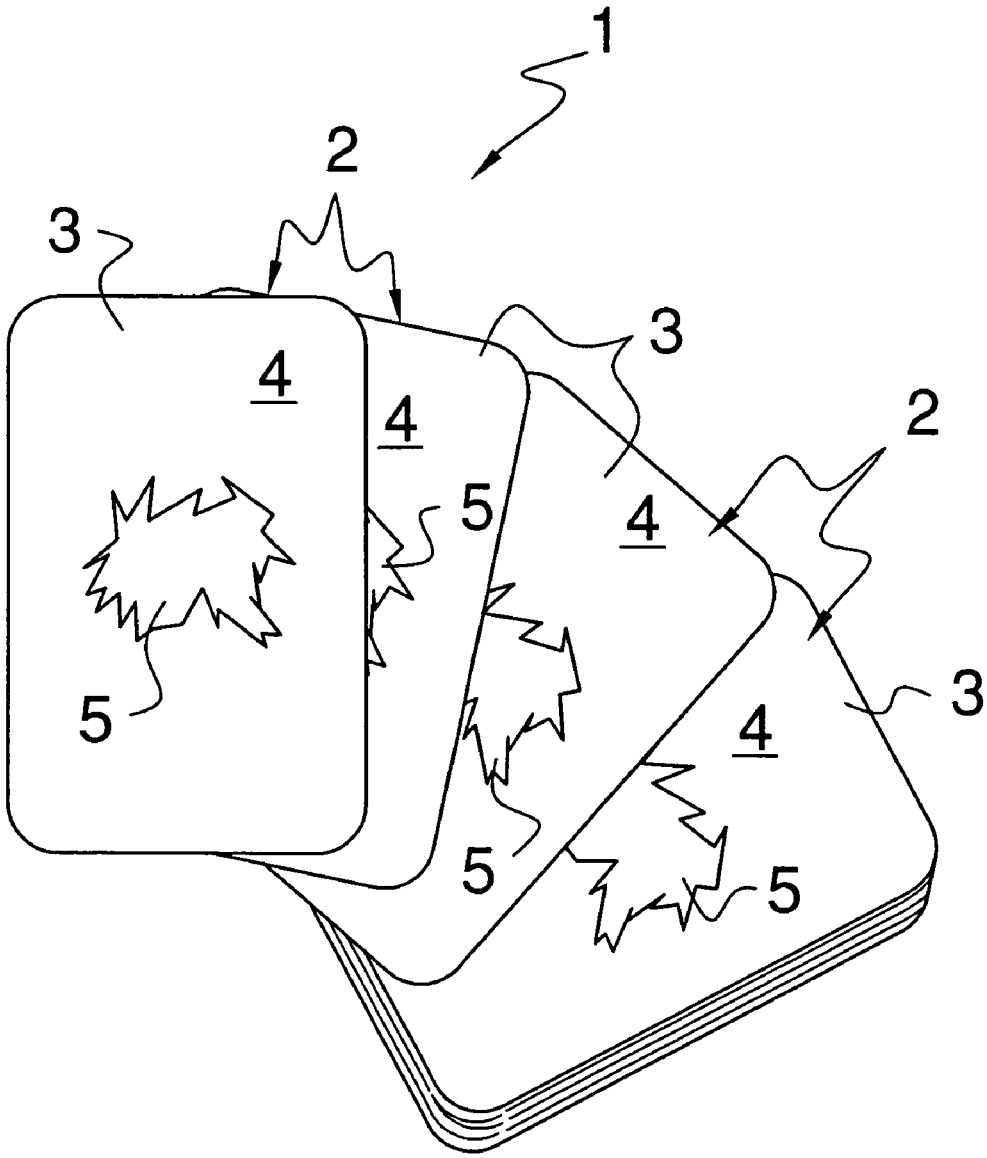
FIG. 1 is a perspective view of a deck of cards used in playing the battle play card game according to the present invention.
Figure 2:
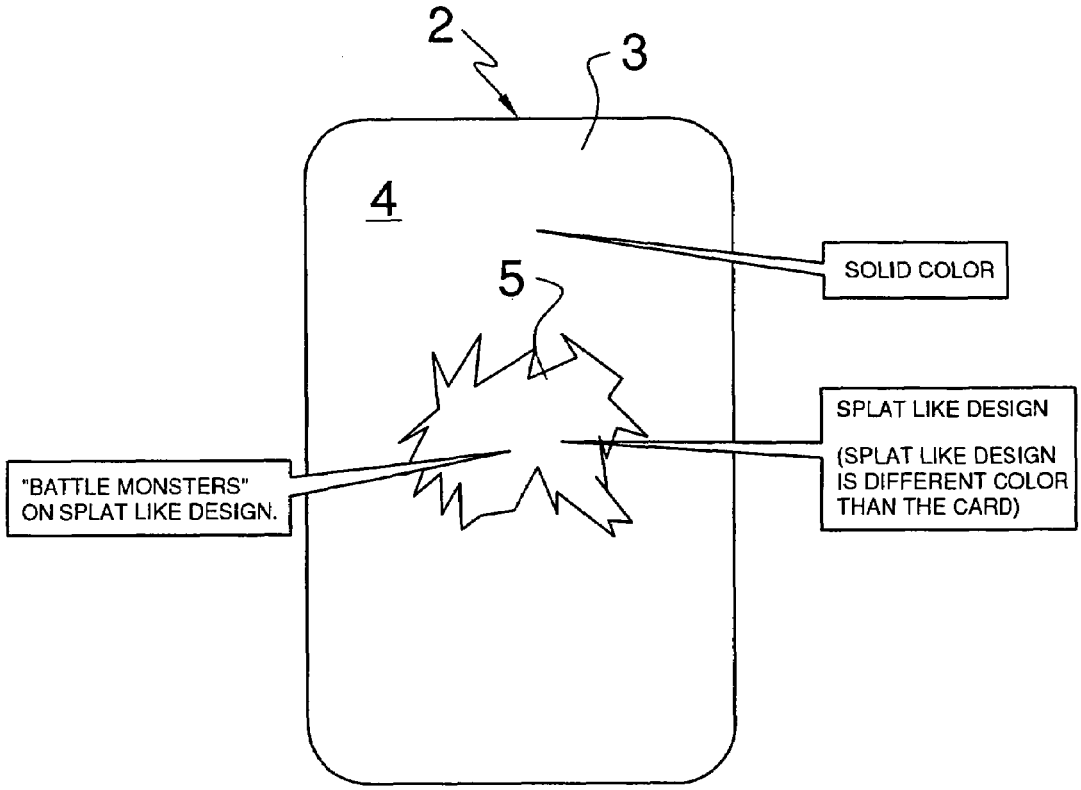
FIG. 2 is a front side view of each playing card in the card deck.

Referring to the drawings, an illustrative card deck which is suitable for use in implementation of the battle play card game according to the present invention is generally indicated by reference numeral 1 in FIG. 1. Briefly, the card deck 1 includes multiple playing cards 2, some of which represent a warrior or beast having a specified number of "offense" points and "protect" points. These playing cards 2 are sequentially played either offensively or defensively by two or more players in an effort to increase the total number of points of each player and deduct points from the total number of points of the opposing player, as well as cause the opposing player to lose the played card, according to the typical rules of play which will be hereinafter further described. Others of the playing cards 2 represent a "snare" or a "curse" which may, for example, cause the opposing player to lose points and/or a card, for example, during card play, as will be hereinafter further described. Each of the playing cards 2 has a front side 3 and a rear side 6. As shown in FIG. 2, the front side 3 of each playing card 2 typically has a solid-colored background 4 and a splat-like insignia 5 typically in the center of the background 4. The splat-like insignia 5 has a color which differs from that of the background 4 and may be printed with the insignia, "BATTLE MONSTERS" or the like.

Figure 3:
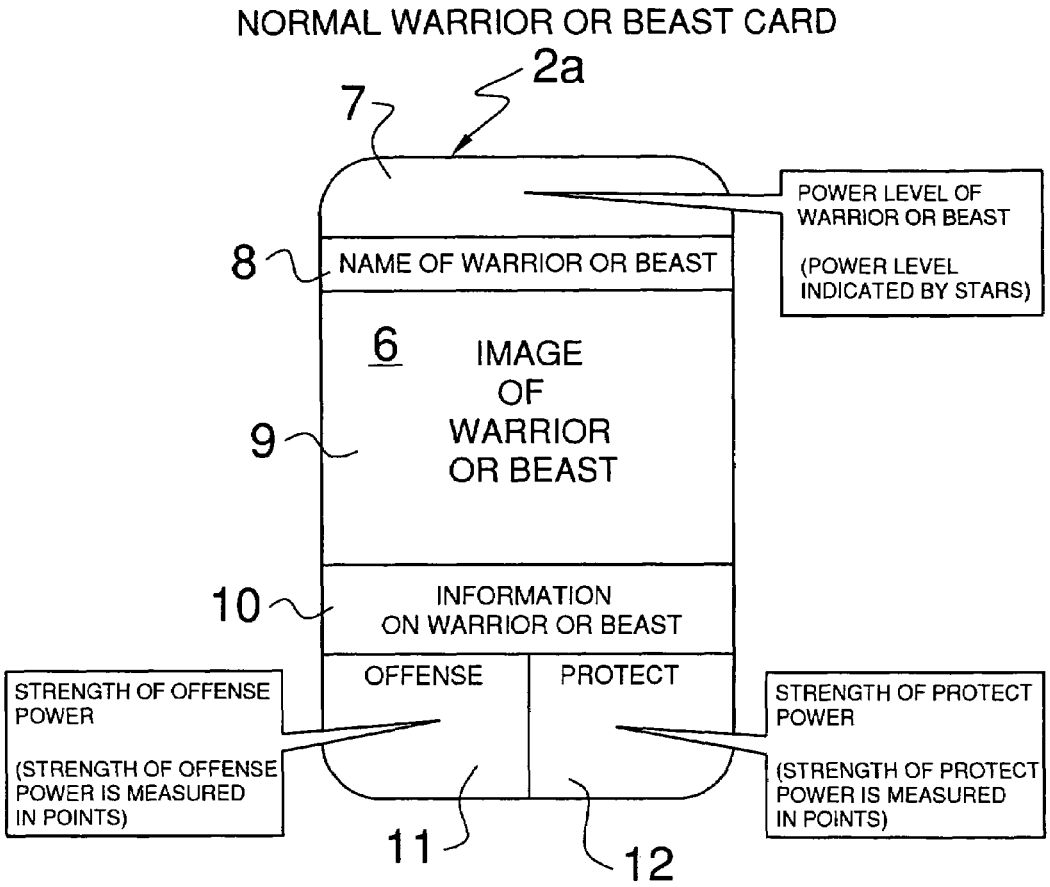
FIG. 3 is a rear side view of a typical warrior/beast card of the card deck.

As shown in FIG. 3, the playing cards 2 typically include multiple warrior/beast cards 2*a*. The rear side 6 of each warrior/beast card 2*a* typically includes a power level section 7, on which is indicated the power level of a warrior or beast presented on the playing card 2, typically by multiple stars (not shown) presented on the power level section 7. For example, the power level of the warrior/beast card 2*a* may range from one star (low power) to four or more stars (high power). A name section 8, on which is provided the name of the warrior or beast, is provided beneath the power level section 7. An image section 9, on which is displayed an image (not shown) of the warrior or beast, is provided beneath the name section 8. An information section 10, on which is provided information about the warrior or beast, may be provided beneath the image section 9. An offense points section 11 and an adjacent protect points section 12 are provided beneath the information section 10. The number of offense points of the warrior/beast card 2*a* appears in the offense points section 11, whereas the number of protect points of the warrior/beast card 2*a* appears in the protect points section 12. The various warrior/beast cards 2*a* in the card deck 1 vary in the number of offense points and the number of protect points. The number of offense points and the number of protect points of the warrior/beast card 2*a* are typically proportional to the power level of the warrior/beast card 2*a* as presented in the power level section 7, and may be the same number of points.

Figure 4:
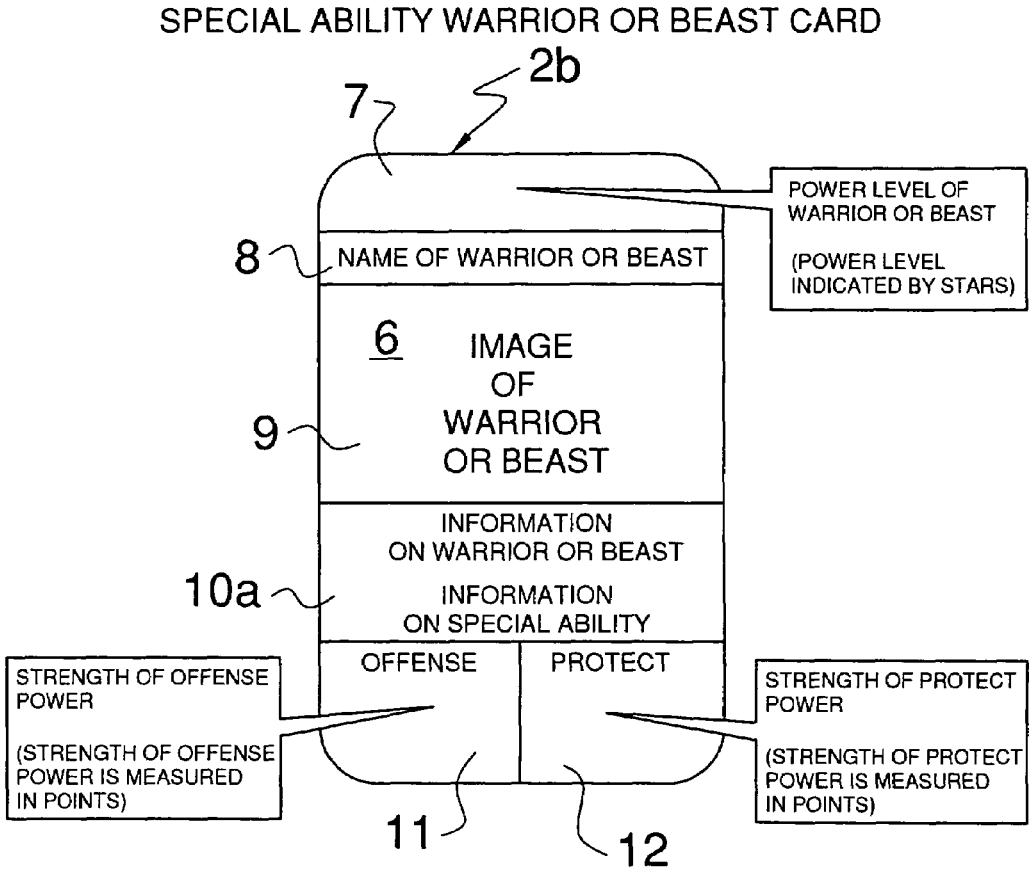
FIG. 4 is a rear side view of a typical special ability warrior/beast card of the card deck.

As shown in FIG. 4, the playing cards 2 typically further include multiple special ability warrior/beast cards 2*b*. The rear side 6 of each special ability warrior/beast card 2*b* typically includes a power level section 7, a name section 8, an image section 9, an offense points section 11 and a protect points section 12, in addition to an information on warrior/beast and information on special ability section 10*a*. The section 10*a* may present a special ability, such as the ability to deduct additional points from the opposing player's score total or the ability to remove one or more of the opposing player's playing cards 2, for example, when the special ability warrior/beast card 2*b* is played.

Figure 5:
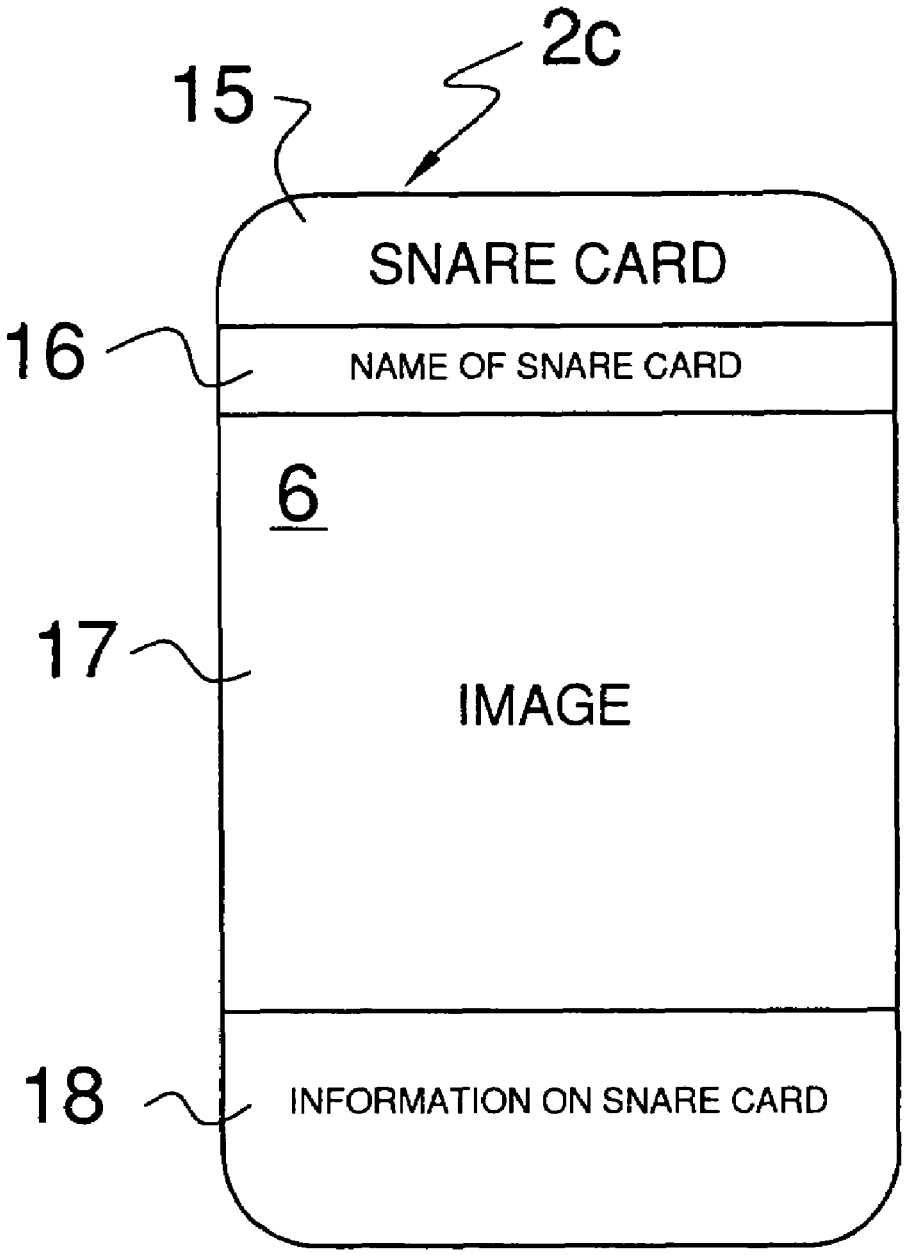
FIG. 5 is a rear side view of a typical snare card of the card deck.

As shown in FIG. 5, the playing cards 2 may further include multiple snare cards 2*c*. The rear side 6 of each snare card 2*c* includes a snare card section 15, on which is printed the insignia, "SNARE CARD". A name of snare card section 16 is provided beneath the snare card section 15. The name of the snare which is represented by the snare card 2*c* is presented in the name of snare card section 16. An image section 17, on which is displayed a selected image which may relate to the snare, is provided beneath the name of snare card section 16. An information section 18 is provided beneath the image section 17. The information section 18 presents information about the snare represented by the snare card 2*c* when the snare card 2*c* is played by one player against another. The snare may include such playing tactics as the deduction of points from the opposing player's score total or loss of a card or cards from the opposing player. The snare may additionally or alternatively include such playing tactics as the addition of points to the point total of the player who plays the snare card 2*c* or the addition of a card or cards to his or her hand of playing cards 2, for example.

Figure 6:
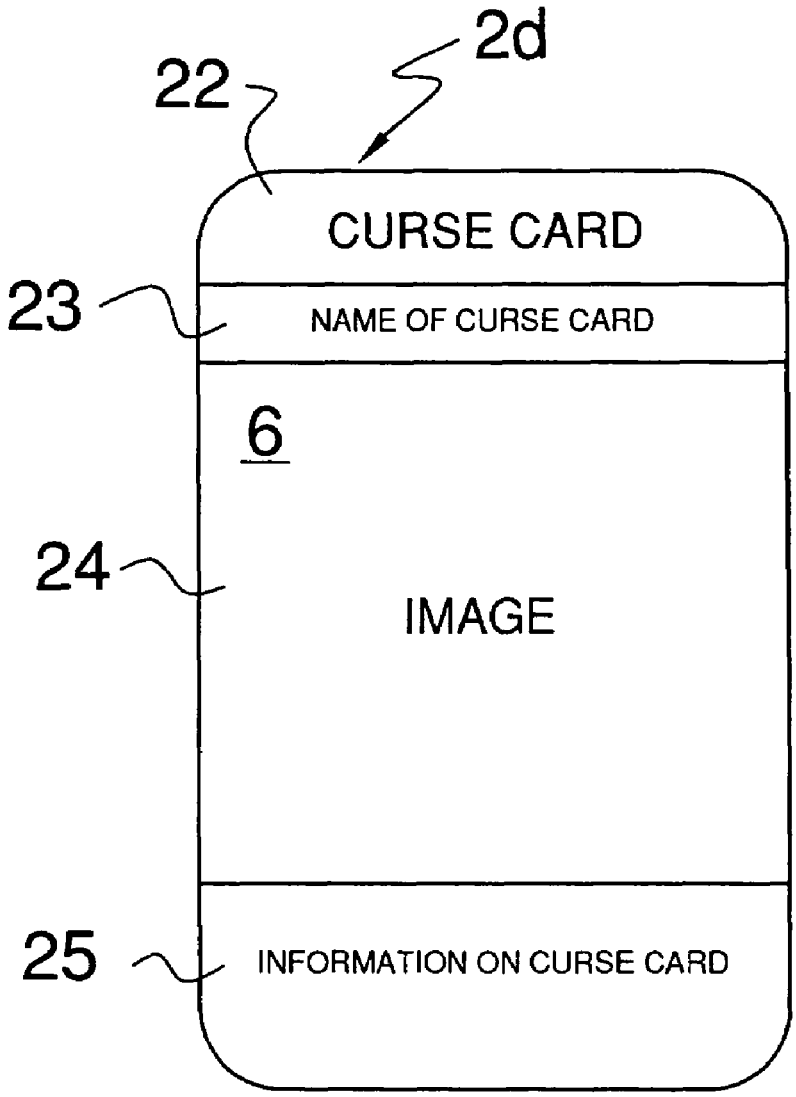
FIG. 6 is a rear side view of a typical curse card of the card deck.

As shown in FIG. 6, the playing cards 2 further include multiple curse cards 2*d*. The rear side 6 of each curse card 2*d* includes a curse card section 22, on which is printed the insignia, "CURSE CARD". A name of curse card section 23 is provided beneath the curse card section 22. The name of the curse which is represented by the curse card 2*d* is presented in the name of curse card section 23. An image section 24, on which is displayed a selected image which may relate to the curse, is provided beneath the name of curse card section 23. An information section 25 is provided beneath the image section 24. The information section 25 presents information about the curse represented by the curse card 2*d* when the curse card 2*d* is played by one player against another. The curse may include such playing tactics as the deduction of points from the opposing player's score total or loss of a card or cards from the opposing player, for example. The curse may additionally or alternatively include such playing tactics as the addition of points to the point total of the player who plays the curse card 2*d* or the addition of a card or cards to his or her hand of playing cards 2, for example. The playing tactics displayed on the curse cards 2*d* may be the same as or different from those displayed on the snare cards 2*c*.

Figure 7:
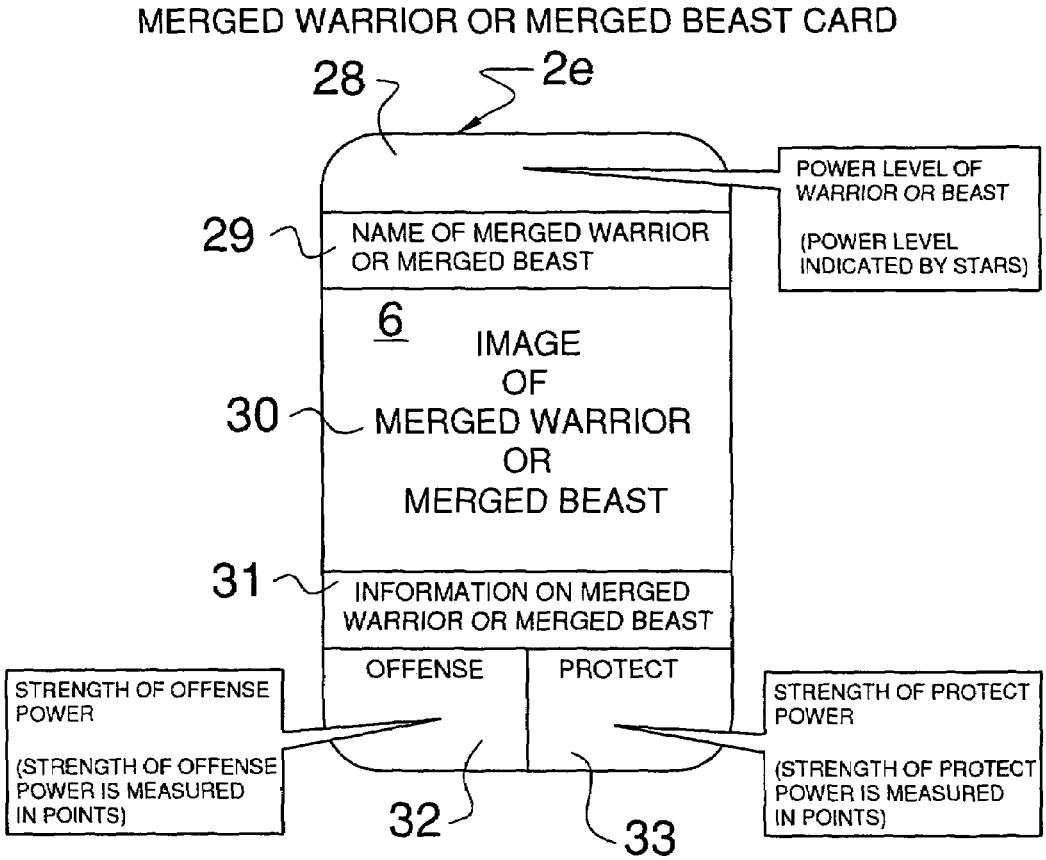
FIG. 7 is a rear side view of a typical merged warrior/beast card of the card deck.

As shown in FIG. 7, the playing cards 2 may further include multiple merged warrior/beast cards 2*e*. The rear side 6 of each merged warrior/beast card 2*e* typically includes a power level section 28, a name section 29, an image section 30, an offense points section 32 and a protect points section 33, in addition to an information on merged warrior/beast section 31. The power level displayed in the power level section 28, as well as the number of offense points displayed on the offense points section 32 and the number of protect points displayed on the protect points section 33, is typically higher than those respective values displayed on the warrior/beast card 2*a* of FIG. 3 and the special ability warrior/beast card 2*b* of FIG. 4.

Figure 8:
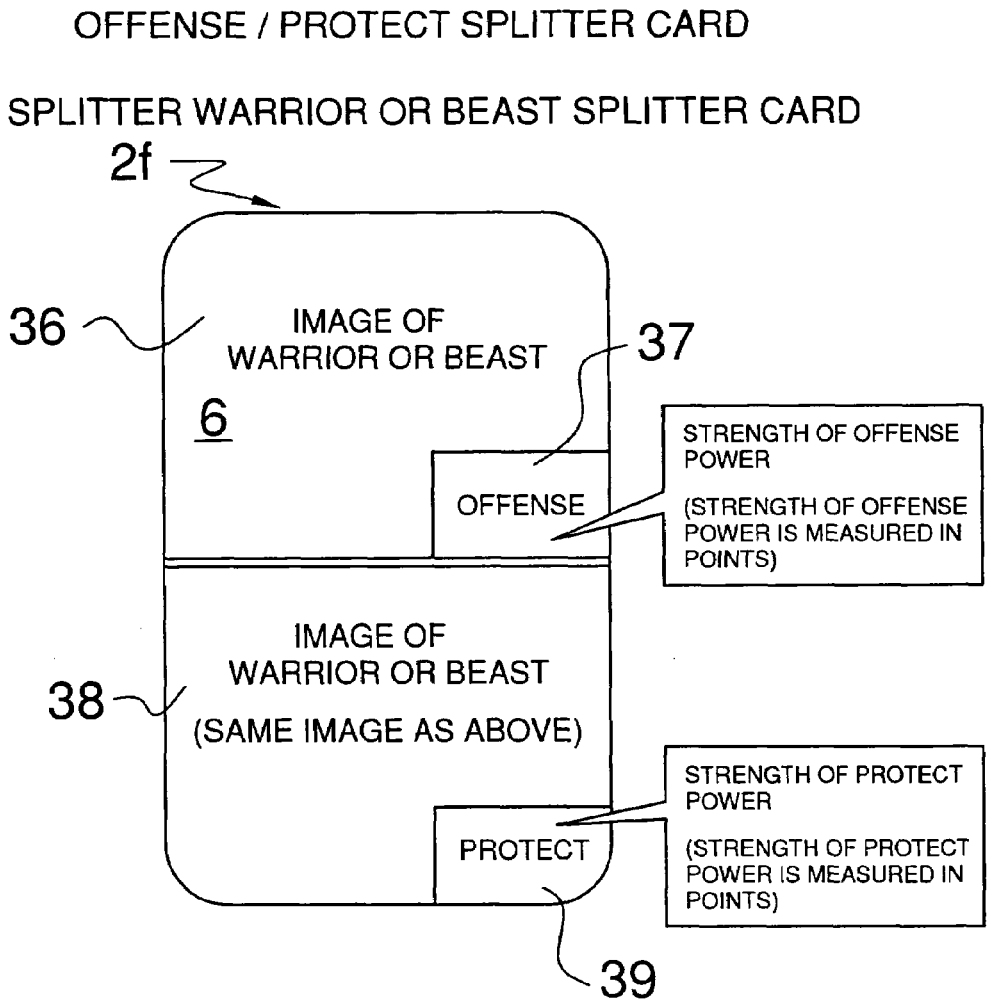
FIG. 8 is a rear side view of a typical offense/protect splitter card of the card deck.

As shown in FIG. 8, the playing cards 2 may further include multiple offense/protect splitter cards 2*f*. The rear side 6 of each offense/protect splitter card 2*f* includes an upper image section 36, on which is displayed the image of a warrior/beast, and a lower image section 38, on which is also displayed the image of the same or a different warrior/beast. An offense points section 37 may be provided as an inset on the upper image section 36, and a protect points section 39 may be provided as an inset on the lower image section 38. A selected number of offense points, which corresponds to the strength of the offensive power of the warrior or beast displayed on the upper image section 36, is displayed on the offense points section 37. In similar fashion, a selected number of protect points, which corresponds to the strength of the protection power of the warrior or beast displayed on the lower image section 38, is displayed on the protect points section 39. In typical play, the offense/protect splitter cards 2*f* can be used either offensively or defensively by a player.

Figure 9:
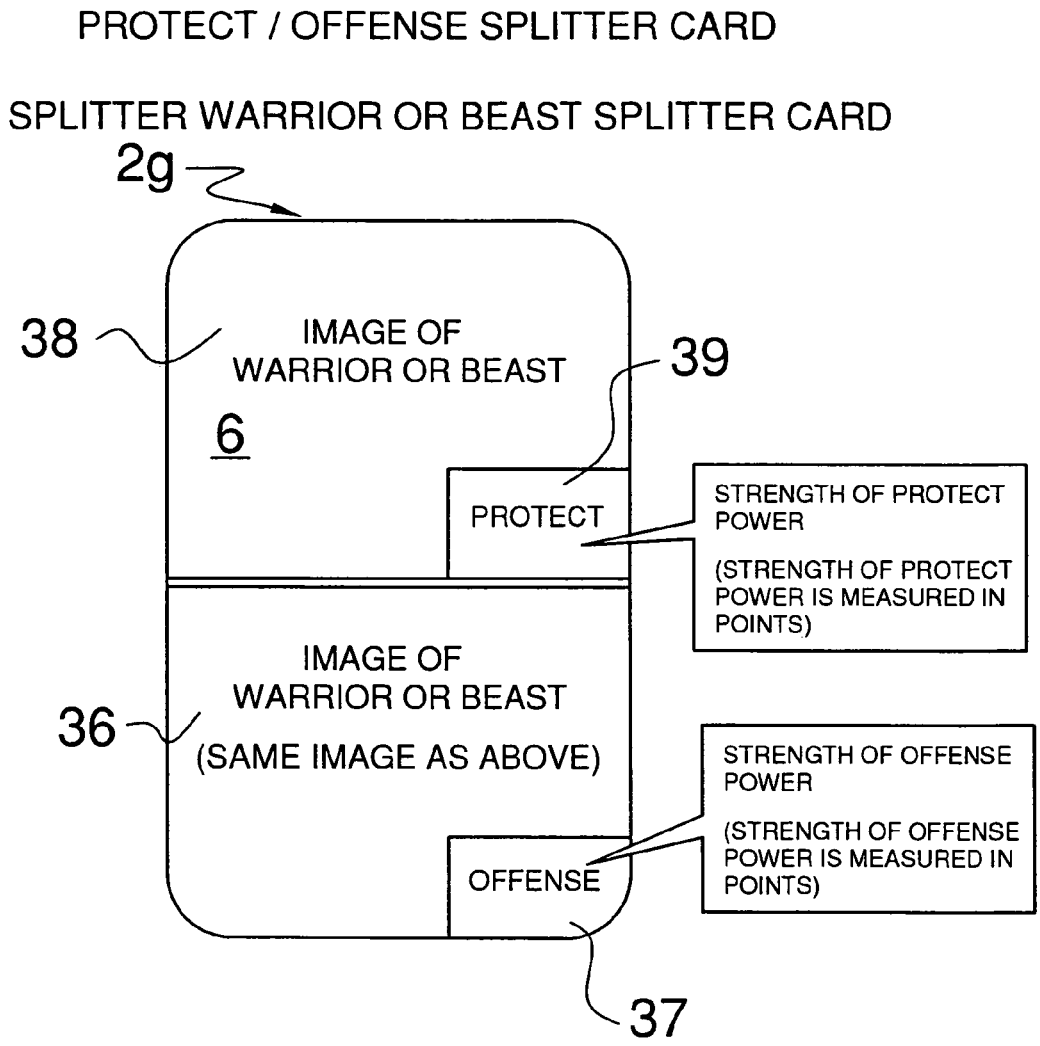
FIG. 9 is a rear side view of a typical protect/offense splitter card of the card deck.

As shown in FIG. 9, the playing cards 2 may further include multiple protect/offense splitter cards 2*g*. The rear side 6 of each protect/offense splitter card 2*g* includes a layout which is similar that shown with respect to the offense/protect splitter card 2*f* of FIG. 8, except the positions of the image sections 36, 38 and the offense points section 37 and the protect points section 39 are reversed.

Figure 10:
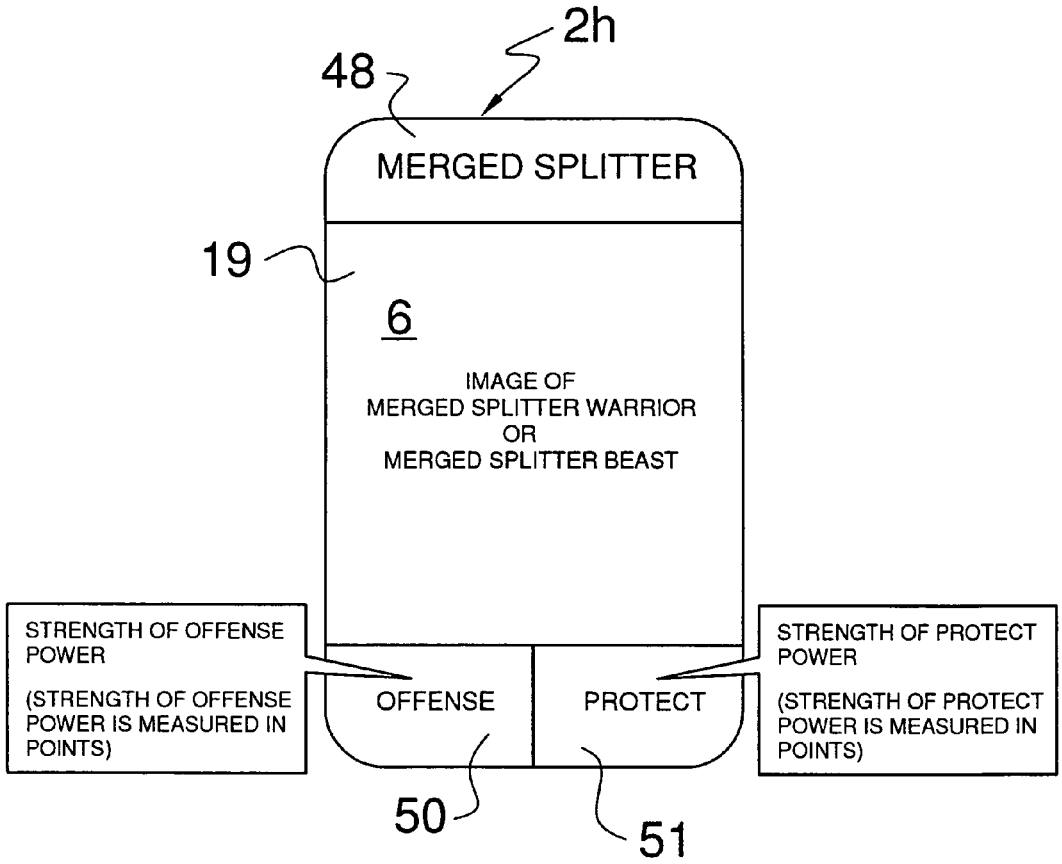
FIG. 10 is a rear side view of a typical merged splitter card of the card deck.

As shown in FIG. 10, the playing cards 2 may further include multiple merged splitter cards 2*h*. The rear side 6 of each merged splitter card 2*h* includes a merged splitter section 48, on which is printed the insignia, "MERGED SPLITTER". An image section 49 is provided beneath the merged splitter section 48. An offense point section 50 and an adjacent protect point section 51 are provided beneath the merged splitter section 48. The number of offense points displayed in the offense point section 50 and the number of protect points displayed in the protect point section 51 of the merged splitter cards 2*h* are typically greater than the number of offense points and the number of protect points displayed on the offense/protect splitter card 2*f* and the protect/offense splitter card 2*g* which were described hereinabove.

According to typical rules of play, the battle play card game is played as follows. After shuffling of the card deck 1, each of two players is initially dealt five cards. On each turn, each player may choose to attack the other player or defend himself from the previous play of the other player using from one up to all five of his or her cards. Depending on the number of offense points and the number of protect points on each playing card 2 played in a given turn, as well as the privileges afforded to each player by the snare card 2*c* and the curse card 2*d* played in the turn, each player, as either the attacker or defender, may gain or lose points, gain or lose a card, or cause his or her opponent to gain or lose points and/or a card.

For example, in the event that the attacker's played cards in a given turn display a total number of offense points which is higher than the total number of offense points that are presented by the defender's cards on his or her subsequent turn, then the defender loses the number of points and the attacker gains the number of points which corresponds to the point difference and also loses a card from among his or her dealt cards. In the event that the number of offense points on the attacker's played cards and the defender's played cards are the same, then neither the attacker nor the defender loses points and both the attacker and the defender loses a card. In the event that the number of offense points on the attacker's played cards is less than the number of offense points on the defender's cards, the attacker loses the number of points which corresponds to the point difference and also loses a card, whereas the defender gains the number of points which corresponds to the point difference.

In the event that the attacker's played cards in a given turn display a total number of offense points which is higher than the total number of protect points that are presented by the defender's cards on his or her subsequent turn, then neither the attacker nor the defender loses any points; however, the defender loses a card from among his or her dealt cards. In the event that the number of offense points on the attacker's played cards equals the number of protect points on the defender's played cards, neither the attacker nor the defender loses points and both the attacker and the defender loses a card. In the event that the number of offense points on the attacker's played cards is less than the number of protect points on the defender's cards, the attacker loses the number of points and the defender gains the number of points which corresponds to the point difference and also loses a card.

An illustration of the scoring system which was outlined above is presented in tabular form below in Table (I).

TABLE I

| ATTACKER | DEFENDER | GAME POINTS RESULT | CARD RESULTS |
|---|---|---|---|
| 400 offense points | 300 offense points | DEFENDER loses and ATTACKER gains 100 game points | DEFENDER loses card |
| 300 offense points | 300 offense points | No points lost by either player | Both cards are lost |
| 200 offense points | 300 offense points | ATTACKER loses and DEFENDER gains 100 game points | ATTACKER loses card |
| 400 offense points | 300 protect points | No game points are lost | DEFENDER loses card |
| 300 offense points | 300 protect points | No game points are lost | Both cards are lost |
| 200 offense points | 300 protect points | ATTACKER loses and DEFENDER gains 100 points | ATTACKER loses card |

It will be appreciated by those skilled in the art that numerous variations of the battle play card game outlined above are possible using the various playing cards 2 from the card deck 1. For example, a "Mega Battle" can be played in which the first player to reach a predetermined number of points, such as 4,000 points, for example, wins the game. Accordingly, each player has his or her own stack of cards and his or her own "defeated" pile, which consists of the cards lost during play. When a player subsequently draws a card, he or she can choose from the "defeated" pile or the community cards, which consists of the cards in the card deck 1 remaining after dealing. All of the remaining rules of play apply. In another variation, a "Tag Team Battle" can be played according to the normal rules of play, except with two players per team. In still another variation, a "Mega Tag Team Battle" can be played according to the "Mega Battle", described above, except two people are on each team.

While the preferred embodiments of the invention have been described above, it will be recognized and understood that various modifications can be made in the invention and the appended claims are intended to cover all such modifications which may fall within the spirit and scope of the invention.

What is claimed is:

1. A method of playing a card game between two players, comprising:

providing a card deck having a plurality of character playing cards each having an offense points section for displaying a numerical value for offense points and a protect points section for displaying a numerical value for protect points;

dealing a hand of said plurality of character playing cards to each of an attacking player and a defending player;

having said attacking player and said defending player sequentially present said hand of said plurality of character playing cards;

determining point differences between said numerical value for offense points for said hand of said attacking player and said numerical value for offense points for said hand of said defending player;

awarding points corresponding to said point differences to said attacking player when said numerical value for offense points for said hand of said attacking player is higher than said numerical value for offense points for said hand of said defending player; and announcing a winner when first one of said attacking player and said defending player accumulates a total point of 4,000.

2. The method of claim 1 further comprising assigning point totals to said attacking player and said defending player and detracting points from said point total of said one of said attacking and defending players when said numerical value for offense points for said one of said attacking and defending players is less than said numerical value for offense points for said hand of said other of said attacking and defending players.

3. The method of claim 2 further comprising removing at least one of said plurality of character playing cards from said hand of said one of said attacking and defending players when said numerical value for offense points for said one of said attacking and defending players is less than said numerical value for offense points for said hand of said other of said attacking and defending players.

4. The method of claim 1 further comprising removing at least one of said plurality of character playing cards from said other of said attacking and defending players when said numerical value for offense points of said one of said attacking and defending players exceeds said numerical value for protect points of said other of said attacking and defending players.

5. The method of claim 1 further comprising removing at least one of said plurality of character playing cards from said one of said attacking and defending players when said numerical value for protect points of said other of said attacking and defending players exceeds said numerical value for offense points of said one of said attacking and defending players.

* * * * *